United States Patent [19]

Hodgson et al.

[11] 3,979,029

[45] Sept. 7, 1976

[54] MULTI-DIRECTIONAL AEROSOL VALVE FOR USE ON AN AEROSOL CONTAINER

[76] Inventors: R. W. Hodgson, 1680 N. Vine St., Hollywood, Calif. 90028; Steve A. Rands, 4353 E. Floral Drive, Los Angeles, Calif. 90022

[22] Filed: Dec. 16, 1974

[21] Appl. No.: 532,998

[52] U.S. Cl. ..... 222/402.17

[51] Int. Cl.[2] ..... B05B 1/16

[58] Field of Search ..... 239/390–397, 239/435–449, 537–540; 251/310, 443, 444, 445; 401/190, 265; 272/394, 402.11, 402.12, 464

[56] References Cited

UNITED STATES PATENTS

| | | | |
|---|---|---|---|
| 2,877,917 | 3/1959 | Brooks et al. | 222/464 |
| 3,309,902 | 3/1967 | Hanamaru | 239/392 X |
| 3,402,862 | 9/1968 | Meshberg | 222/536 X |
| 3,795,366 | 3/1974 | McGhie | 239/397 |

*Primary Examiner*—Stanley H. Tollberg

[57] ABSTRACT

A multi-directional aerosol valve for use on a pressurized aerosol container (usually a can) to provide for substantially completely emptying such an aerosol can in any selected one of multiple directions, usually ranging between the conventional lateral direction and a vertical direction and, in certain cases, including various different angular directions lying therebetween. This type of multi-directional valve makes it possible to emit the aerosol spray in a variety of different directions and greatly facilitates and broadens the scope of its applicatory usage.

8 Claims, 11 Drawing Figures

MULTI-DIRECTIONAL AEROSOL VALVE FOR USE ON AN AEROSOL CONTAINER

BACKGROUND OF THE INVENTION

The field of the invention is generally that of aerosol containers and, more particularly, controllably operable aerosol dispensing valves for such pressurized aerosol containers which can be finger-operated (usually by depressing same temporarily against the action of a biasing spring) so as to dispense an aerosol spray, which is usually, in conventional prior art devices of this sort, dispensed in a substantially transversely or laterally directed manner with respect to the vertical direction of the aerosol can. In other words, in such prior art aerosol containers and valves, the majority of the dispensing of the contents of the aerosol can is substantially lateral in direction, although a small amount of tipping, either below or somewhat above, a direct lateral dispensing direction is possible in such prior art aerosol cans and valves. However, if, for example, the aerosol can contains paint, or other applicatory liquid, which it to be applied to an overhead ceiling surface or the like for painting same, it will be found that conventional aerosol cans and valves are not suitable for the task. Even an effort to dispense such an aerosol liquid in a substantially downward direction on a lower horizontal surface is very inefficient. These problems arise primarily from the fact that the aerosol valve is generally fed from the lower open end of an inner dip tube positioned near the bottom of the aerosol can and inside of same within the pressurized liquid which is to be dispensed, and whenever the aerosol can it tilted or tipped very much away from a true vertical orientation, there is an increasing tendency, as the contents of the can become reduced through the dispensing of same, for the open remote end of the inner dip tube to become positioned out of the pressurized liquid which has been tiltably displaced away from the inner open end of the dip tube within the aerosol can. This prevents effective spraying action of the pressurized liquid from occurring except when the can is substantially completely full of the pressurized liquid and before very much dispensing of same has occured. Thus, when a pressurized aerosol can of paint, or the like, is newly purchased, it can be sprayed in a number of different vertically angularly displaced directions for a while, but as the inner contents of the can become reduced, the range of vertical displacement of the spraying direction which will function efficiently becomes progressively reduced until finally it will be found that the substantially reduced contents of the aerosol can will, of necessity, be subsequently dispensed only in a substantially lateral direction or slightly thereabove or slightly therebelow. It is precisely for the purpose of freeing an aerosol can and valve from the above-mentioned vertical angular spraying direction limitation that the present invention was developed, since it provides an aerosol valve which will allow spraying or virtually the entire contents of the aerosol can in either a lateral direction or a vertical direction or various angular directions therebetween and also in at least one form will allow the spraying of the contents in angular directions substantially depressed below a transverse or lateral direction also. These advantages flow from and occur by reason of the specific features of the invention pointed out hereinafter.

SUMMARY OF THE INVENTION

Generally speaking, the mutli-directional aerosol valve of the present invention comprises a digitally or manually controllably openable dispensing valve adapted to be attached to an aerosol container (usually a can) at a convenient dispensing location (usually in a top wall of such an aerosol can) and with an interior portion thereof extending into the interior of the aerosol can, and with an exterior dispensing portion lying exterior of the aerosol can and being provided a differently directable, spray-discharging-cap carried by the exterior portion of the dispensing valve and including controllably operable and movable selector means for allowing a spray-discharging direction to be selected by a person digitally operating same so that the resultant pressurized spray emitted from the cap will be in a selected one of multiple directions. In one preferred exemplary form of the invention, the dispensing valve includes a hollow valve housing capable of being affixed to a top wall of an aerosol can, a hollow valve body within the hollow valve housing and having a dip tube attached to a bottom portion thereof and extending downwardly toward a remote bottom portion of the aerosol can and, in one preferred form, being angularly deflected relative to the longitudinal axis of the aerosol can toward one edge thereof for facilitating the capability of completely discharging virtually all of the contents of the aerosol can and for improving the angular positioning range between a lateral spray-discharging direction and a substantially downward spray-discharging direction through which the dispensing valve will operate effectively and will continue to properly discharge the pressurized contents of the aerosol can. The dispensing valve, in said preferred form, also includes a hollow, longitudinally movable valve stem having passage means therein for dispensing pressurized liquid material from within such an aerosol can, with said valve stem having a closed end which reciprocates within the previously-mentioned hollow valve a body and having cap-attaching means at its other (usually upper) end, which upper end protrudes through the previously-mentioned hollow valve housing to a position exterior and above the top wall of the pressurized aerosol can. In the preferred form, the dispensing valve also includes valve sealing gasketing means for said passage means and further includes valve stem biasing means (usually spring means) cooperable for biasing the valve stem so that said passage means of said valve stem is biased against said sealing gasketing means to maintain said valve stem and said passage means in a normally sealed, closed condition and biased into a maximum extension position (which is usually a miximum upward extension position). In a preferred form, the dispensing valve means further includes a direction-of-spray-controlling valve cap means adapted to be mounted on the otherwise open upper end of the valve stem at a location above and exterior of the top wall of the pressurized aerosol can and controllably, manually, or digitally adjustable in a manner such as to control the direction of spray discharge when the dispensing valve is operated into temporary open condition so that the emitted spray will be directed in a selected one of multiple different possible spray-discharging directions. In one preferred form of the invention, the spray-direction-controlling cap means includes multiple spray-discharging orifice means, such as a lateral spray-discharging orifice means and a vertical spray-discharging orifice means, although not specifically so limited, and controllably operable selector means for selecting a desired one of said multiple different spray-discharging orifice means and effectively activating the selected one while inactivating the non-selected one (or ones) of the multiple spray-discharging orifices so that operation of the dispensing valve in a temporary spray-discharging manner will cause the emitted spray to pass through the selected and effectively activated one of the multiple spray-discharging orifices and, consequently, be emitted in a selected one of the multiple, spray-discharging directions. In another form of the invention, the differently directable, spray-discharging orifice means of the cap does not comprise multiple, individual, different spray-discharging orifices, but, instead, comprises a single spray-discharging orifice carried by a movable (usually vertically pivotally movable) nozzle means controllably manually movable through multiple different spray-discharging directions, usually including at least a lateral spray-discharging direction and an upward spray-discharging direction (although not specifically so limited) and, in some cases, including other different spray-discharging directions in addition to multiple, different, angular spray-discharging directions lying between those just mentioned. There are various other types of alternate selector and/or activation and inactivation means lying within the broad scope of the present invention, such as the use of multiple spray-discharging orifices controlled by multiple, different, controllably openable and closable valves which, in certain cases, might be needle valves or any other functional equivalent, thus making it possible to select the spray direction by merely closing and effectively inactivating non-selected spray-discharging orifices and leaving open only the selected spray-discharging orifice, or various other functionally equivalent selector and activation and inactivation means may be employed in lieu of the specific arrangements just described.

For example, a composite structure, or separate independent structures, carrying different spray-discharging orifice means aimed in different spray-discharging selected directions may be provided with corresponding, multiple, controllably independently engageable, means for engaging the open top of the valve stem of the aerosol dispensing valve and thus, in effect, this multiple engaging structure will comprise the controllably operable selector means and effective activation and inactivation means previously mentioned in these modified forms of the invention, all of which lie within the broad scope of the present invention.

OBJECTS OF THE INVENTION

With the above points in mind, it is an object of the present invention to provide a novel multi-directional aerosol valve for use on a variety of different types of aerosol containers so as to greatly expand the scope of the range to spray-discharging direction for an aerosol dispensing valve and which is of the character referred to herein generically and/or specifically and which may include any or all of the features referred to herein (or functional equivalents), either individually or in combination, and which is of extremely east-to-use construction suitable for use by relatively inexperienced persons and which is of relatively simple, inexpensive, easy-to-manufacture, easy-to-mount, and easy-to-install construction suitable for ready mass production and distribution thereof in any ot its various forms at extremely low cost, both as to the initial capital cost (including production set-up cost) and as to the subsequent per-unit manufacturing cost, whereby to be conductive to widespread production, distribution, and sale of the novel direction-controlling aerosol valve of the present invention as a complete unit supplied with a pressurized aerosol can initially or, in a sub-combination form of the invention, as a replacement for a pre-existing conventional aerosol valve cap so as to convert a conventional aerosol dispensing valve into a direction-of-spray-controlling-and-adjusting aerosol valve cap and dispensing aerosol valve combination intended for the purposes outlined herein or for any substantially equivalent or similar purposes.

Further objects are implicit in the detailed description which follows hereinafter (which is to be considered as exemplary of, but not specifically limiting, the present invention), and said objects will be apparent to persons skilled in the art after a careful study of the detailed description which follows.

For the purpose of clarifying the nature of the present invention, several exemplary embodiments of the invention are illustrated in the hereinbelow-described figures of the accompanying single drawing sheet and are described in detail hereinafter.

DESCRIPTION OF THE PREFERRED EMBODIMENTS

Figures 1, 2, 3, 4, 5, 6, 7, 8, 9, 10, 11:
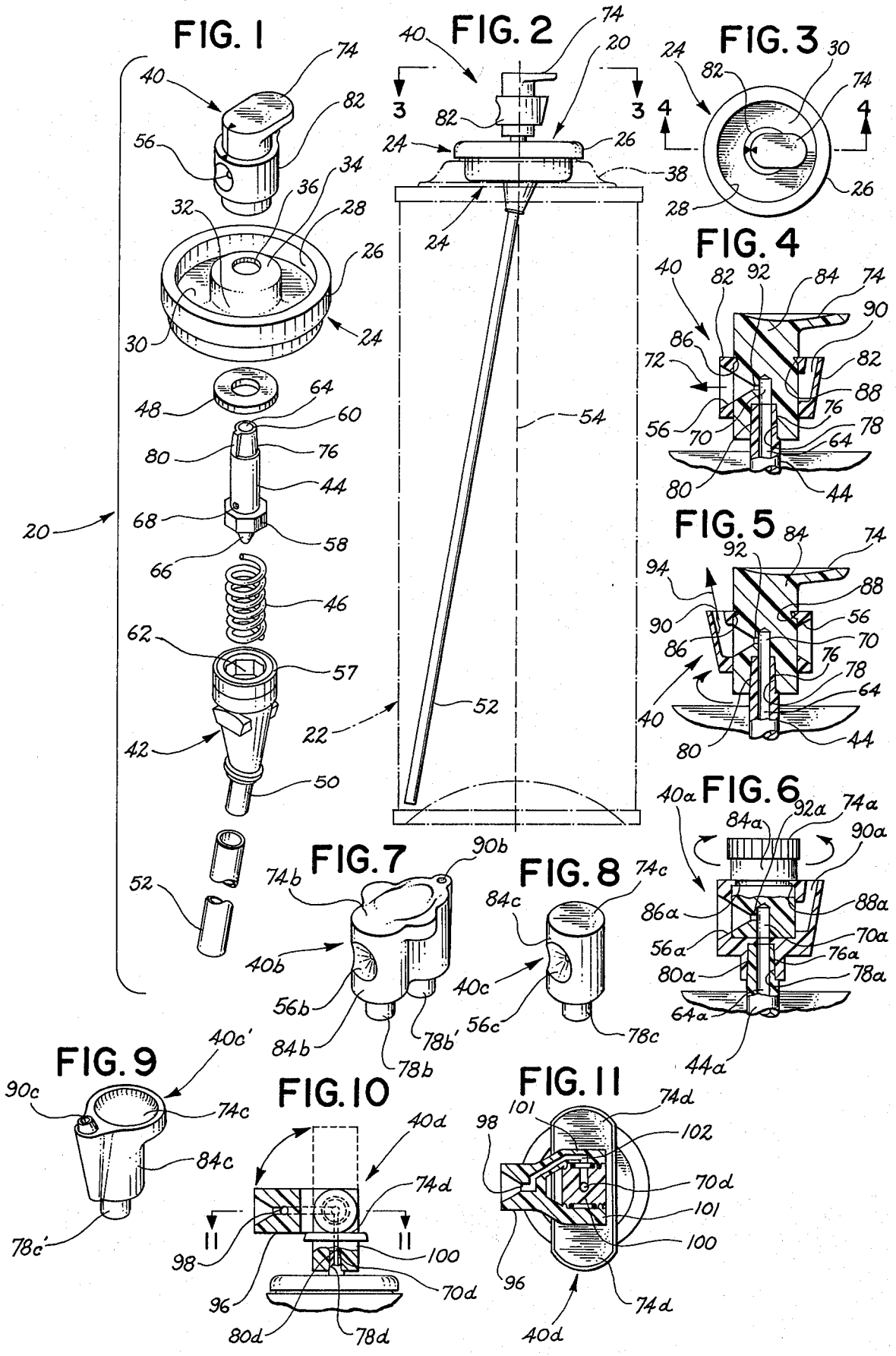
FIG. 1 is a fragmentary, vertically-exploded view of one representative form of the invention with the body of a conventional pressurized aerosol container or can being removed from this view for reasons of drawing simplification and clarity and so that the vertically-exploded operating parts of the push button aerosol valve and of the controllably operable spray-direction-controlling cap can be clearly seen and understood.
FIG. 2 is a side elevational view of the representative mutli-directional aerosol valve of FIG. 1 in fully-assembled relationship and also shown in mounted relationship with respect to a typical representative pressurized aerosol can (which is shown in phantom lines since it may be modified substantially and since it does not touch upon the real inventive concept of the invention).
FIG. 3 is a top plan view taken in the direction of the arrows 3—3 of FIG. 2 of the valve apparatus of FIG. 2 and of that solid-line portion of the top wall central closure member for a pressurized aerosol can. In other words, the entire phantom line aerosol can of FIG. 2, except for the solid-line central top wall closure portion thereof, is entirely removed and deleted from FIG. 3.
FIG. 4 is an enlarged, fragmentary, largely cross-sectional view taken substantially along the plane and in the direction indicated by the arrows 4—4 of FIG. 3 and clearly illustrates the spray-direction-controlling cap in the lateral spray-discharging direction.
FIG. 5 illustrates the apparatus of FIG. 4 with the spray-direction-controlling cap in the alternate adjusted position wherein it directs the emitted spray in a substantially upward direction.
FIG. 6 is a view generally similar to FIG. 4 although with a top part being shown in elevation rather than in section and, furthermore, illustrates a slight modification of the invention wherein the spray-direction-controlling cap still functions in the same manner as the two alternate lateral and vertical selection positions of the first form of the invention illustrated in FIGS. 4 and 5, but in this case in a manner wherein the relative rotating part comprises the central inner portion of the cap rather than the outer portion of the cap which is the rotatable part as shown in the first version thereof illustrated in FIGS. 4 and 5.
FIG. 7 is an isometric view illustrating a further slight variation of the cap wherein the selection of the lateral spray direction of the vertical spray direction is accomplished in a somewhat different manner from the showing of the two alternate selector positions of the first form of the invention as illustrated in FIGS. 4 and 5, respectively, and from the slight variation thereof as illustrated in the second form of the invention shown in FIG. 6 — in this modification comprising the engagement of a corresponding one of the two downwardly directed valve-stem-receiving sockets of the FIG. 7 showing, with the single upwardly-directed hollow valve stem extending through the top wall of the aerosol can.
FIGS. 8 and 9, taken together, comprise a further simplification and slight variation of the invention actually comprising the mere separation of the composite FIG. 7 form into two parts, each of which is independently and alternately usable.
FIGS. 10 and 11 illustrate a further modification of the invention having a swingable outlet nozzle capable of adjusting the spray-discharging direction from a lateral direction to a vertical direction or to any angular position therebetween.

An exemplary representative first form of the invention is illustrated in FIGS. 1–5 inclusive wherein the invention essentially comprises a multi-directional aerosol valve for use on a pressurized aerosol container (which is usually a substantially cylindrical can) and which makes it possible to substantially completely empty the pressurized contents of the aerosol can in any selected one of multiple directions — usually multiple directions in a vertical plane substantially co-planar with the longitudinal axis of the valve itself and of the aerosol can, although not specifically so limited in all variations of the invention. In the exemplary first form illustrated, the entire multi-directional aerosol valve is essentially shown in vertically exploded relationship in FIG. 1, and is generally designated by the reference numeral 20, and a typical representative pressurized aerosol can is shown in phantom lines in FIG. 2, and is indicated generally at 22. FIGS. 3—5, inclusive, show top wall portions of the pressurized aerosol can in solid lines, comprising the centrally positioned top wall closure portion of the pressurized aerosol can which is shown as the second vertically exploded element in FIG. 1, and which is also shown in solid lines in its proper mounted relationship in FIG. 2. It is shown in solid lines primarily because it comprises an essential part of the multi-directional aerosol valve 20 in addition to comprising a central top-wall closing part of the aerosol can 22.

In the particular exemplary representative first form of the invention illustrated, a multi-directional aerosol valve, indicated generally at 20, comprises a dual element which, in one aspect, may be said to be a hollow valve housing capable of being affixed to a top wall of an aerosol container or can and which, in another aspect thereof, can be said to comprise the above-mentioned central top wall sealing and closing part of the aerosol can which is shown in solid lines, either wholly or fragmentarily in all of FIGS. 1–5 inclusive and which is generally designated by the reference numeral 24. It should be noted that the hollow valve housing 24 includes an outer rolled-over rim or edge portion 26, an inner downwardly directed vertical wall portion 28, terminating in a bottom, inwardly directed substantially horizontal wall portion 30, which, at a central, symmetrically located position, is provided with an upwardly directed, hollow, inverted cup-shaped portion 32 having a top wall portion 34 provided with a central valve stem outlet opening 36. In a preferred form of the invention, the entire hollow valve housing 24 just described is of formed, integral construction, preferably made of stamped metal, although not specifically so limited, and its construction is such as to make it suitable for sealed, fixed mounting in the top wall of the aerosol can 22, which top wall is shown in phantom lines at 38 in FIG. 2. It should be clearly noted that the entire hollow valve housing 24 is adapted to be sealed in place in the aerosol can top wall 38 by a mechanical crimping and sealing in place, by the use of suitable adhesive, sealiing, and/or gasketing material effectively interposed therebetween or interconnecting same, or in a variety of manners well-known in the art and not touching upon the real inventive concept of the present invention.

It should be noted that, in a general way, it can be said that the multi-directional aerosol valve, in its first representative form as shown in FIGS. 1–5 inclusive, includes a pressurized aerosol dispensing valve which carries a cap which, in effect, comprises and provides the multi-directional feature of the present invention, and that major portions of the aerosol dispensing valve are located at and below the level of the inverted cup-shaped structure 32 of the hollow valve housing 24 (with a minor exception to be noted hereinafter) while the entire multi-directional spray-controlling cap structure is located above said inverted cup-shaped structure 32 of the hollow valve housing 34. The spray-direction-controlling cap means is generally designated by the reference numeral 40 and will be described in detail hereinafter.

The aerosol dispensing valve just referred to above comprises a hollow valve body, such as is generally designated at 42 in FIG. 1, a hollow, upwardly directed valve stem, such as is indicated by the reference numeral 44, valve stem biasing means which, in the example illustrated, comprises the spring 46, valve sealing gasketing means, one form of which is indicated at 48, and the previously mentioned hollow valve housing 24. The valve body 42 is provided with a dip tube attaching means 50, to which a dip tube, such as is indicated at 52, is adapted to be attached in the manner best shown in FIG. 2. It should be noted that, in the example illustrated, the dip tube attaching means 50 is angularly directed and that, consequently, the dip tube 52 is also angularly directed with respect to a vertical center line 54 of the valve and of the entire can 22 whereby the bottom end of the dip tube is directed toward a bottom corner or peripheral edge of the aerosol can 22 which, in the example illustrated, is on the same side of the vertical center line 54 of both the valve and the aerosol can as a lateral spray-discharging orifice means 56 of the cap 40, which will be described in greater detail hereinafter. This arrangement of the bottom end of the dip tube 52 facilitates the virtually complete emptying of the aerosol can's contents and, while it is a preferred arrangement, the invention is not specifically limited to this particular angular orientation of the dip tube 52 in all forms of the invention.

The above-mentioned angular orientation of the dip tube 52 will be automatically assumed when the entire valve structure 20 is assembled and is ready for insertion into, and crimping into, the previously open crown top portion 38 of the aerosol can 22.

The aerosol dispensing valve also includes an enlarged upper portion 57 of cup shape for receiving the valve stem biasing means 46 which, in the example illustrated, comprises a helical spring of the proper size, and the lower closed end 58 of the tubular valve stem 44. The valve sealing gasketing means 48 encircles the valve stem 44 to act as the sealing means. The inverted cup 32 completes the actual valve assembly, receiving all of the vertically exploded parts lying directly therebelow in FIG. 1 down to and including the enlarged upper portion 57 of the valve body 42. The fully assembled relationship thereof is shown externally in FIG. 2, while the vertically exploded relationship, showing the details of each of said valve parts, is clearly shown in FIG. 1, and it will be clearly understood that when in the assembled relationship shown in FIG. 2, the upper end 60 of the hollow valve stem 44 will extend upwardly through the valve stem egress aperture 36 of the inverted cup-shaped member 32 of the hollow valve housing, indicated generally at 24, and will be available to receive and properly mount the previously mentioned cap 40 thereon at a position spaced above the top of the entire hollow valve housing 24 in the manner most clearly shown in FIGS. 2, 4, and 5.

The inside surface 62 of the valve body 42 may assume any configuration, but as best shown in FIG. 1 in the preferred first form of the invention, it has an octagonal configuration to receive the matching octagonal outer surface of the lower closed end 58 carried by the bottom of the hollow valve stem 44. The result of these co-acting surfaces is to guide the valve stem during relative reciprocating movement thereof within the valve body 42. In addition to the lower closed end 58, the valve stem 44 also has the previously mentioned hollow tubular configuration in its upper portion, with a hollow interior as indicated at 64, which acts as a passageway for the pressurized material to be dispensed from the aerosol can 22.

The bottom surface of the closed end 58 has a bottom boss 66 with a diameter slightly less than the diameter of the valve stem spring 46 whereby control over lateral movement of the spring 46 within the hollow valve body 42 is effected. The hollow tubular valve stem 44 has a discharge orifice or passage 68 (which, in the example illustrated, is laterally directed and on one side thereof) communicating with the central vertical passageway 64, and effectively comprising a part thereof, although not specifically limited to this precise structure in all forms of the invention, and which, when in fully vertically assembled relationship with respect to the rest of the valve parts of FIG. 1, is effectively sealed by the sealing gasketing means 48, which normally effectively closes and seals the complete valve means 20 until such time as the entire valve stem 44 is forcibly digitally moved downwardly against the action of the biasing spring 46 so as to unseat the discharge orifice or passageway 68 from the sealing gasketing means 48, which allows the pressurized contents of the aerosol can 22 to be dispensed upwardly through the hollow interior 64 of the valve stem 44 and into the hollow interior of the cap 40 mounted on the upper end 60 of the valve stem 44 so that the discharged pressurized material will be emitted into the hollow interior bore 70 within the central interior of the cap 40 and will then pass transversely through the conical, transversely directed outlet nozzle or spray discharge orifice 56 so that the emitted spray, as indicated by the arrow 72 in FIG. 4, will be substantially laterally directed for as long as the entire valve stem 44 is forcibly digitally maintained in such a downwardly displaced position. As soon as the digital pressure is removed from the top operating member 74 of the cap 40, the biasing spring 46 will move the valve stem 44 upwardly and will again sealingly re-engage the discharge orifice or passageway 68 with the sealing gasketing ring 48 and the valve will be effectively sealed and closed again and, thus, the transversely directed spray 72 of the aerosol can's contents will cease.

It should be noted that the open upper end of the valve stem 44 around and immediately below the apertured extreme top end 60 thereof is effectively provided with what might be termed cap-attaching means which is designated by the reference numeral 76 and which, in the example illustrated, merely comprises a somewhat-tapered and conical, slightly-reduced-diameter, upper portion of the valve stem having a shoulder at its lower terminus and being adapted to be received by a corresponding cooperable cap-attaching means carried by the cap 40 which, in the example illustrated, comprises a somewhat-tapered receiving bore 78 centrally carried by the bottom of the cap member 40 for a force-fit engagement with said tapered conical cap-attaching upper end 76 of the valve stem 44 in the manner best shown in FIGS. 4 and 5. Incidentally, it should be noted that said cap-attaching means 76 carried by the upper end of the valve stem 44 may optionally be provided with rotary positioning means, such as key means or the like, one representative form of which is indicated at 80, which cooperates with correspondingly shaped, non-rotative or keyed portions in the receiving, cap-attaching means 78 carried by the bottom of the cap 40 so as to determine the relative rotative positions of each of same when attached in the manner shown in FIGS. 2–5 inclusive so that the laterally directed spray-discharging orifice 56 of the cap means 40, when in the selected operative position shown in FIGS. 2, 3, and 4, will automatically be directed in the same transverse or lateral direction as the forward angular displacement of the bottom end of the dip tube 52. This means that spray may be laterally discharged from within the aerosol can 22, substantially completely either in the lateral direction shown in FIG. 4 or, when tipped in a counter-clockwise direction therefrom, so as to cause the lateral spray to now have a downward angular directional component. Also, the shoulder at the bottom of the tapered cap-attaching upper end 76 of the valve stem 44 automatically determines the extent of the downward engaging movement of the cap 40 when it is placed in engagement therewith.

The cap 40 is provided with differently directable spray-discharging orifice means for making it possible to direct spray discharged from within the pressurized can 22 in multiple different selected directions. In the exemplary first form of the invention illustrated in FIGS. 1-5 inclusive, and differently directable, spray-discharging orifice means is of a two-element type comprising what might be referred to as a multiple spray-discharging orifice means including controllably operable selector means and activation and inactivation means and two discharge orifices, either one of which can be rendered effective or active while the other is rendered ineffective and inactive according to the operation of the controllably operable selector means. In the exemplary first form of the invention illustrated, the selector means and the activation and inactivation means comprises first and second relatively movable cap portions which, in the example illustrated, comprising an outer hollow sleeve-shaped cap portion 82 relatively rotatively receiving and being mounted on a second inner cap element 84. The first cap element 82 has a circular vertical bore extending therethrough of a size such as to be adapted to resiliently and substantially sealingly receive vertically therethrough the cylindrical exterior surface of the second inner cap element 84, as is perhaps best shown in FIGS. 4 and 5. In the example illustrated, they are snapped into place and retained by an inwardly directed, resilient annular shoulder 86 and a corresponding annular recess 88, although various other retaining means functionally equivalent thereof may be used in lieu of the specific retaining structure just described. In the first example illustrated, it is the inner cap member portion 84 which has the bottom cap-attaching bore 78 positioned therein and, thus, it normally remains in a fixedly mounted position on the upper cap-attaching means 76 of the hollow valve stem 44, which is in communication with the inner hollow cap chamber 70 previously mentioned for communication of either of the two orifices including the previously described laterally directed orifice 56 and the yet-to-be-described upward orifice 90 according to the relative rotation of the outside cap portion 82 with respect to the fixed inside cap portion 84 between the lateral spray-discharging condition shown in FIG. 4 and the upward spray-discharging condition shown in FIG. 5. The outer rotary cap member portion 82 has the lateral spray-discharging orifice 56 positioned for rotary alignment with the small, transversely directed outlet jet opening 92 of the central inner member cap chamber 70 when the two cap portions 82 and 84 are in the lateral spray-discharging position, which has been selected by the operation of the selector and activation and inactivation means, comprising the relative rotation of the outer cap portion 82 with respect to the inner cap portion 84 into the appropriate lateral discharging selected position best illustrated in FIG. 4. Conversely, said selector and activation and inactivation means comprising the two elements 82 and 84 may be relatively rotated through substantially a 180-degree displacement movement into the upward spray-discharging selected position illustrated in FIG. 5 wherein the upwardly directed discharge orifice 90 is now in communication with the small outlet jet hole 92 of the central inner cap member chamber 70 so that spray will be emitted outwardly and upwardly in the upward spray direction designated by the arrow 94 in FIG. 5.

It will be noted that in FIG. 4 said two relatively rotatable elements 82 and 84 have, in effect, inactivated the upward discharge orifice 90, while activating the lateral discharge orifice 56 and that, conversely, in FIG. 5 the relative 180-degree displacement of the two selector elements 82 and 84 has effectively activated the upward discharge orifice 90 while effectively inactivating the lateral discharge orifice 56. This is best accomplished by merely grasping the exterior of the outer ring-shaped member 82 and rotating it between the lateral discharging position of FIG. 4 and the upward discharging position of FIG.5, or vice versa.

FIG. 6 merely illustrates a slight modification and, therefore, corresponding parts are designated by similar reference numerals, followed by the letter *a*, however. In this modification, it will be noted that the outer member 82*a*, instead of the inner member 84*a*, is the one which is affixed to the upper end 76*a* of the valve stem 44*a* and, thus, its rotary position is predetermined and it is the operating handle 74*a* carried by the upper end of the inner member 84*a* which is relatively rotated in order to select a lateral spray-discharging direction such as is shown in FIG. 6 and an upward spray-discharging direction, which requires 180° rotation of the upper operating handle portion 74*a*. Of course, in this case this modification requires that the inner member 84*a* does not extend through the bottom of the outer member 82*a* in a manner similar to the relationship of 82 and 84 as best shown in FIGS. 4 and 5. Instead, the bottom of the outer member 82*a* is effectively closed except for the passage therethrough of the previously mentioned central recess 70*a* within the inner member 84*a*. Otherwise, this modification is both structurally and functionally similar to the first form of the invention and it is believed that any further detailed description thereof would be redundant.

FIG. 7 illustrates a further slight variation wherein generally similar parts are designated by similar reference numerals, followed by the letter *b*, however. In this modification, there are two downwardly directed, hollow, upwardly-tapered, cap-attaching, hollow receiver bores within the two cap-attaching members shown at 78*b* and 78*b'* and each is adapted to be selectively engaged on the tapered upper cap-attaching portion of the valve stem in a manner similar to the engagement of the cap-attaching portion 76 of the valve stem 44 clearly shown in FIGS. 4 and 5 of the first form of the invention and, therefore, not again repeated. In this modification, the major difference is the fact that the left valve stem receiver 78*b* communicates with a laterally directed discharge orifice 56*b* in a manner substantially identical to the showing of FIG. 4 of the first form of the invention and there is no communication whatsoever with the upwardly directed discharge orifice 90*b*. However, when the other valve stem receiver 78*b'* is engaged with the upper end of the tubular valve stem, it communicates directly with the upward spray discharge orifice 90*b* in a manner substantially identical to the showing of FIG. 5 of the first form of the invention and there is no communication whatsoever with the lateral discharge orifice 56*b*. Thus, either a lateral spray-discharging direction or an upward spray-discharging direction can be selected by the use of the appropriate valve stem receiver in the FIG. 7 modification.

FIGS. 8 and 9 merely illustrate the separated equivalents of the composite selector arrangement shown in FIG. 7 and; therefore, corresponding reference numerals, followed by the letter *c*, however, designate corresponding parts in FIGS. 8 annd 9 wherein it will be noticed that when the valve stem receiver 78*c* is in communication with the valve stem, the lateral spray discharge orifice 56c will be the only one which has been selected while, when the valve stem receiver 78*c'* is the one engaged with the valve stem, the upward spray discharge orifice 90*c* will be the one which has been selected. Otherwise, the selector arrangements of FIGS. 8 and 9 are substantially equivalent to previously described forms, and no further description thereof is thought necessary or desirable.

FIGS. 10 and 11 illustrate another modification wherein the differently directable spray-discharging orifice means is not a type which includes two discrete spray-discharging orifices, such as the lateral spray-discharging orifice 56 and the upward spray-discharging orifice 90 of the first form of the invention, but instead comprises a single nozzle 96 having an outlet spray-discharging orifice 98 therein and with the entire nozzle 96 being pivotally mounted with respect to another cap portion 100 which has the valve stem receiver 78*d* therein which is equivalent to that shown at 78 of the first form of the invention. It will be noted that the pivotally mounted nozzle 96, in the exemplary form illustrated in FIGS. 10 and 11, is a bifurcated, a split-yoke-shaped structure, 101 for movement in a vertical plane between a lateral direction, a vertical direction, and any angular direction positioned therebetween by merely vertically pivotally moving the nozzle 96 to any selected discharge direction. Either of the two yoke portions 101, or both of same, can be provided with inner duct means, such as the representative showing at 102, which communicates the central discharge orifice or chamber 70*d* with the outlet orifice 98 of the swingable nozzle 96 so that when the entire cap assembly is pressed downwardly by either of the two operating portions 74*d* so as to open the aerosol dispensing valve, such as that shown at 20 and previously described in detail in connection with the first form of the invention, the pressurized contents of the aerosol can will be sprayed out of the nozzle 96 in any selected spary direction within the range of movement of the outlet nozzle such as the representative range of movement thereof shown in FIG. 10, for example, although not specifically so limited.

It should be noted that the directional terms "lateral" and laterally, upward and upwardly, and vertical and vertically, are all to be construed as being of a broad relative type and are not intended to be interpreted in a specific narrow manner meaning exactly horizontal or exactly vertical. In other words, any substantially laterally directed spray, or spray-discharging direction, having a major laterally or substantially horizontal directed component is intended to be included within the scope of the intended broad meaning of the words lateral and laterally, and any substantially upwardly directed spray, or spray-discharging direction, having a substantial vertical component, even if associated with a laterally directed component so as to actually be angularly displaced somewhat from a true vertical direction is intended to be included within the broad scope of the intended meaning of the previously mentioned words upward, upwardly, vertical, and vertically when applied to the spray-discharging orifice means or the spray discharge therefrom, and all of said words or terms throughout the specification and claims are to be broadly construed in accordance with the intended meanings thereof, as just generally defined.

It should also be noted that the particular kind of selector means and effective openable and closable valve means connecting the lateral spray-discharging orifice and the upward spray-discharging orifice with respect to the valve stem, as illustrated in considerable detail in FIGS. 4 and 5 in one representative form, and as illustrated in FIG. 6 in a slightly varied form, are not intended to be construed in a specific, narrow, limiting sense. Actually, said representative shownings in FIGS. 4 and 5, and the slightly varied representative showing in FIG. 6, are intended to be merely illustrative of multiple, functionally equivalent arrangements which are intended to be included and comprehended herein. For example, instead of the relative rotating two-part structures shown in FIGS. 4 and 5 in one form and in FIG. 6 in another form, the two different spray-discharging orifices and, in particular, the duct means communicating therewith may be provided with either jointly operable or independently operable valve means of any desired type, such as two different controllably openable and closable needle valves, for example, so that either one can be opened or closed. In such an arrangement, normally the selected one will be opened while the non-selected one will be closed, thus rendering the selected spray-discharging orifice effectively operable by activating same, while effectively rendering the non-selected spray-discharging orifice inoperative and effectively inactivated. A variety of types of valves capable of functioning in an equivalent manner may be employed in lieu of the specifically illustrated structures of the foregoing described representative forms thereof.

Also, it should be noted that while a preferred form of the invention will employ molded plastic construction for as many of the parts thereof as possible in order to minimize per-unit production costs in high-volume production, the invention is not specifically so limited and various suitable materials or various combinations thereof may be employed as dictated by the proposed circumstances of use and the proposed initial capital cost and subsequent per-unit production costs, specifications, and requirements.

It should be understood that the figures and the specific description thereof set forth in this application are for the purpose of illustrating the present invention and are not to be construed as limiting the present invention to the precise and detailed specific structure shown in the figures and specifically described hereinbefore. Rather, the real invention is intended to include substantially equivalent constructions embodying the basic teachings and inventive concept of the present invention.

What is claimed is:

1. A multi-directional aerosol valve for use on an aerosol container to provide for substantially completely emptying such an aerosol container in any selected one of multiple directions relative to the longitudinal axis of such a container, comprising: a hollow valve housing capable of being affixed to a top wall of such a container; a valve body within said hollow valve housing and having a dip tube attaching means adjacent to a bottom portion thereof; a dip tube affixed to said attaching means; a hollow, longitudinally movable valve stem having passage means therein for dispensing pressurized liquid material from within such a container, said stem having a closed end which reciprocates within said hollow valve body and having cap-attaching means on its other end, said other end protruding upwardly through said hollow valve housing; valve sealing gasketing means for said passage means; valve stem biasing means cooperable for biasing said valve stem so that said passage means of said valve stem is biased against said sealing means to maintain said valve stem and passage means in a normally sealed, closed condition biased into a maximum extension position; and stem-covering valve cap means having controllably selectively operable, differently directible spray-discharging orifice means; said differently directible spray-discharging orifice means of said valve cap means being provided with controllably operable and movable selector means for selecting multiple different spray-discharging directions for said orifice means including at least one substantially laterally facing direction and at least one substantially upwardly facing direction and with said controllably operable and movable selector means also effectively functioning as activation and inactivation means for controllably inactivating the non-selected ones of said multiple different spray-discharging directions of said orifice means other than the selected spray-discharging direction selected by said controllably operable and movable selector means which is effectively activated thereby, said selector means comprising a common rotary sleeve member carried by and comprising a portion of said cap means for rotary displacement between a first lateral discharge selector position and a second vertical discharge selector position.

2. A multi-directional aerosol valve as defined in claim 1, wherein said stem-covering valve cap means is provided with cooperable cap-attaching means for attaching said cap means to said cap-attaching means of said valve stem for firm affixation thereby of said cap means to said other end of said valve stem for digitally-caused forcible movement thereof against the action of said valve stem biasing means to disengage said valve sealing means from said passage means when pressurized liquid is intended to be discharged from within an aerosol container in a selected one of said multiple different spray-discharging directions of said orifice means of said stem-covering valve cap means.

3. A multi-directional aerosol valve as defined in claim 1, wherein said dip tube attaching means is effectively angled with respect to the vertical center line of said valve whereby said dip tube is directed toward the bottom corner or peripheral edge of an aerosol container during use.

4. A multi-directional aerosol valve as defined in claim 1, wherein said dip tube attaching means is effectively angled with respect to the vertical center line of said valve whereby said dip tube is directed toward the bottom corner or peripheral edge of an aerosol container during use, said bottom corner being on the same side of said vertical center line as said spray-discharging orifice means when in an effectively laterally directed selected operable condition.

5. A multi-directional aerosol valve as defined in claim 4, wherein said cap-attaching means of said valve cap means and said valve stem effectively connecting same together are so angularly rotatably positioned with respect to each other and relative to the center line of swaid valve as to provide proper positioning of said spray-discharging orifice means in an effectively laterally directed selected operable condition with respect to the angular direction of said dip tube.

6. A multi-directional aerosol valve as defined in claim 1, wherein said controllably operable and movable selector means and said effective activation and inactivation means thereof comprise vertically pivotally movable nozzle means movable through multiple different spray-discharging directions including at least said lateral spray-discharging and said upward spray-discharging direction while remaining in communication with said hollow valve stem.

7. A multi-directional aerosol valve as defined in claim 1, wherein said multiple spray-discharging orifice means of said valve cap comprises at least one laterally directed spray-discharging orifice means and further comprises at least one substantially upwardly directed spray-discharging orifice means and wherein said selector means, effectively functioning as said activation and inactivation means, controllably operates for effectively inactivating one of said two spray-discharging orifice means and for controllably activating the other of two spray-discharging orifice means in a controllably effectively reversible and interchangeable manner.

8. A multi-directional aerosol valve as defined in claim 7, wherein said selector means comprises first duct means within said cap means effectively communicating with said hollow valve stem at one end and provided with a transversely directed first output discharge vent hole at the other end and controllably operable effective valve means for effectively opening and closing said duct means, said selector means comprising second duct means within said cap effectively communicating with said hollow valve stem at one end and provided with a substantially upwardly directed second output discharge vent hole at the other end and said controllably operable effective valve means for effectively opening and closing said duct means.

* * * * *